United States Patent [19]

Grau

[11] 4,008,561

[45] Feb. 22, 1977

[54] OPEN-END SPINNING DEVICE

[75] Inventor: Gerhard Grau, Albershausen, Germany

[73] Assignee: Zinser Textilmaschinen GmbH, Ebersbach, Germany

[22] Filed: Oct. 11, 1974

[21] Appl. No.: 514,086

[30] Foreign Application Priority Data

Oct. 11, 1973 Germany ..... 2351092

[52] U.S. Cl. ..... 57/56; 57/58.89

[51] Int. Cl.[2] ..... D01H 1/12; D01H 11/00

[58] Field of Search ..... 57/56, 58.89, 58.95

[56] References Cited

UNITED STATES PATENTS

| | | | |
|---|---|---|---|
| 3,524,312 | 8/1970 | Landwehrkamp et al. | 57/56 |
| 3,597,911 | 8/1971 | Schiltknecht | 57/56 |
| 3,763,641 | 10/1973 | Doudlebsky et al. | 57/56 |
| 3,796,034 | 3/1974 | Grau | 57/56 |
| 3,845,612 | 11/1974 | Chisholm et al. | 57/56 |
| 3,859,779 | 1/1975 | Furstenberg | 57/58.89 |

*Primary Examiner*—John Petrakes
*Attorney, Agent, or Firm*—Edwin E. Greigg

[57] ABSTRACT

An open-end spinning device includes a spinning rotor having an axis of rotation, a bottom face and a lateral sliding face conically widening toward the bottom face and intended for receiving fibers which have been fed into the spinning rotor. A fiber collecting groove is located between the bottom face and the sliding face. A blast air opening having an axis is disposed on a stationary part of the spinning device adjacent to an inner chamber of the spinning rotor for feeding air to blow fibers and foreign bodies from the fiber collecting groove. A shallow, concave curve defines an inwardly curved portion of the bottom surface of the spinning rotor between its axis of rotation and the fiber collecting groove. The axis of the blast air opening is directed toward the inwardly curved surface of said bottom.

8 Claims, 1 Drawing Figure

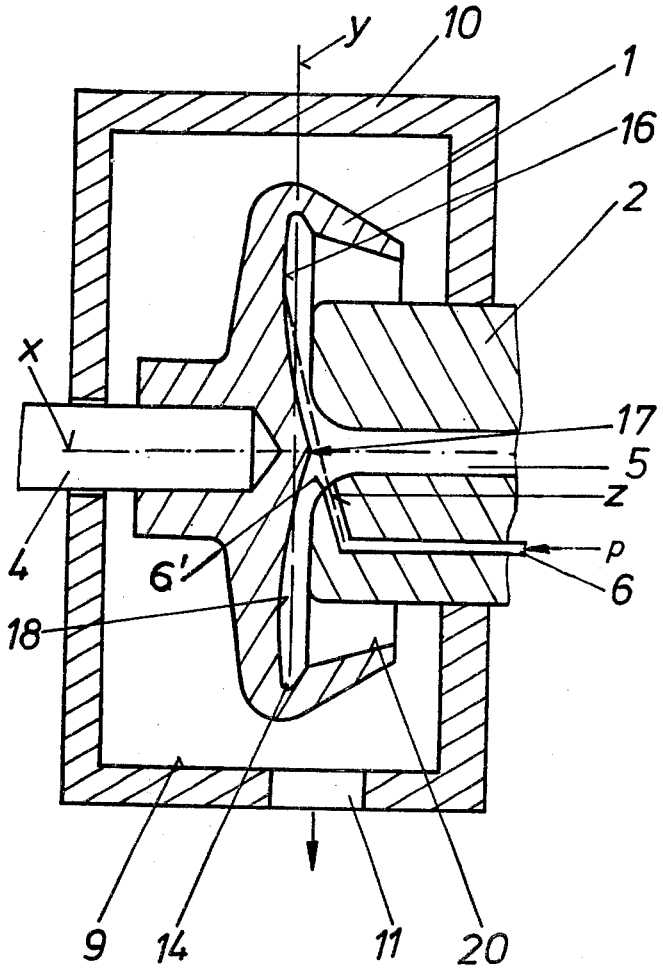
y
10
1
16
2
x
17
5
z
p
6
4
6'
18
9
14
11
20

OPEN-END SPINNING DEVICE

BACKGROUND OF THE INVENTION

This invention relates to an open-end spinning device which includes a spinning rotor. The present invention relates more particularly to an open-end spinning device which includes a spinning rotor having a bottom face, a lateral sliding face widening conically towards the bottom face and provided for the fibers which have been fed into the spinning rotor, and a fiber collecting groove between the bottom face and the sliding surface. The open-end spinning device further has a blast air opening in a stationary part of the spinning device adjacent to an inner chamber of the spinning rotor. This blast opening is provided so that fibers and foreign bodies can be blown out of the fiber collecting groove for purposes of cleaning the same.

It has been found that the fiber collecting groove in the case of spinning devices of this type can frequently only be cleaned in a very unsatisfactory manner by the jet of air from the blast nozzle. Fibers lying in the fiber collecting groove which are no longer bound up with the fibers which have been removed, are frequently intertwined or twisted by the air jet to form a fiber ring which cannot be separated owing to its inner cohesion and which, as a result of its outer dimensions, cannot be lifted independently from the fiber collecting groove.

To reliably free the spinning rotor of residual fibers and impurities in the fiber collecting groove by means of the air jet, it is proposed according to the present invention that the bottom face of the spinning rotor be provided with a shallow, concave curved portion between the axis of rotation of the spinning rotor and the fiber collecting groove, and that the axis of the blast opening be directed towards this inwardly curved portion of the bottom face.

The air jet in operation skims, in the manner of a fan, over the curved portion of the bottom face of the spinning rotor, reaches the fiber collecting groove below the fibers and foreign bodies deposited thereon and effectively lifts these over the sliding surface and the edge of the spinning rotor into the spinning chamber surrounding the spinning rotor, from where these fibers and foreign bodies are removed by suction.

The foregoing object, as well as others which are to become clear from the text below, is achieved in an open-end spinning device which includes a spinning rotor having an axis of rotation, a bottom face, a lateral sliding face conically widening toward the bottom face and intended for receiving fibers which have been fed into the spinning rotor. A fiber collecting groove is located between the bottom face and the sliding face. A blast air opening having an axis is disposed on a stationary part of the spinning device adjacent to an inner chamber of the spinning rotor for blowing fibers and foreign bodies from the fiber collecting groove to clean the same. A shallow, concave curve defining an inwardly curved portion of the bottom surface of the spinning rotor is provided between the axis of rotation of the spinning rotor and the fiber collecting groove. The axis of the blast opening is directed toward the inwardly curved surface of said bottom.

Advantageously, the axis of the blast opening is directed toward the bottom face of the spinning rotor at an acute angle. In many cases, it can also be advantageous for the axis of the blast opening to be directed generally tangentially onto the bottom face.

Advantageously, the bottom face of the spinning rotor possesses with respect to a plane perpendicular to the axis of rotation of the spinning rotor defined by the line of the largest diameter of the fiber collecting groove, a raised section on the axis of rotation and a depressed section between the axis of rotation and the collecting groove. In an especially advantageous embodiment, the deepest point of the depressed area in the bottom surface of the spinning rotor is located at a distance from the axis of rotation of the spinning rotor; this distance being greater than half the distance between the axis of rotation and the fiber collecting groove and being between two thirds and three quarters of the distance between the axis of rotation and the fiber collecting groove.

The difference in height between the highest point of the raised section and the deepest point of the depressed section in the bottom face of the spinning rotor in a direction parallel to the axis of rotation of the spinning rotor is advantageously between one twentieth and one tenth of the diameter of the fiber collecting groove.

Other objects, features and advantages of the present invention will be made apparent from the following detailed description of a preferred embodiment thereof which is provided with reference to the accompanying drawing.

BRIEF DESCRIPTION OF THE DRAWING

The sole FIGURE of drawing shows a section through a spinning chamber of an open-end spinning machine having a spinning rotor, elements which are not essential not being shown to simplify the drawing.

DETAILED DESCRIPTION OF THE PREFERRED EMBODIMENT

The open-end spinning device shown in the drawing includes conventional, known features and members, certain of which are not represented, for the sake of clarity and simplification and is provided with a spinning chamber 9 in a housing designated by the reference number 10. A spinning rotor 1 which is axially symmetrical in respect to its axis of rotation, is disposed in the spinning chamber 9. This spinning rotor 1 is adapted for rotation in a bearing in a manner known per se, which has thus not been represented in further detail, and is adapted to be driven via a shaft 4. A stationary spinning plate 2, a cylindrical part of which projects into the spinning rotor 1, is provided with an axially extending thread discharge channel 5 and a blast air duct 6 discharging at the mouth of the thread discharge channel 5. The separated, individual fibers are supplied, in a manner known per se, through a fiber supply channel which is not represented or visible in the drawing, but which is disposed in the stationary spinning plate 2 and through which the individual fibers to be spun into a thread are conveyed into the inner chamber of the spinning rotor 1 by means of an air current. In the inner chamber of the spinning rotor 1 the fibers are formed into a thread through rotation of the spinning rotor 1 and the thread is removed through the thread discharge channel 5 by means of a pair of conventional take-off rollers which are not represented.

Impurities such as foreign bodies or twisted fibers which collect in a fiber collecting groove 14 of the spinning rotor 1 during the spinning process are blown out by an air jet *p* which can be blown into the inner part of the rotor 1 from a compressed air source, which is not represented, by way of the blast air duct 6. It is especially advantageous for the blast air to be directed through the spinning rotor 1 and the fiber collecting groove 14 in the manner of a cleaning air stream. According to the invention, the blast air jet *p* can be guided in this way by providing the axially symmetrical bottom face 16 of the spinning rotor 1 with a shallow, concave curve between the axis of rotation X of the spinning rotor 1 and the fiber collecting groove 14; an axis Z of a blast air discharge opening 6' at the end of the blast air duct 6, that is, the axis Z of the air discharge opening 6' being directed generally tangentially. The axis Z of the discharge opening 6' of the blast air duct 6 then forms an obtuse angle with the axis of rotation X of the spinning rotor 1.

The air jet *p* is then only switched on, in a manner known per se, for a short period of time when the fiber collecting groove is to be cleaned.

The concave curve in the bottom face 16 is designed in such a way that it possesses, with respect to a plane *y*, which is perpendicular to the axis of rotation X of the spinning rotor 1 and which intersects the fiber collecting groove 14 along the line of its largest diameter, on the axis of rotation X of the spinning rotor 1 a highest point 17 which drops down toward the fiber collecting groove 14. The deepest point 18 of the curved part of the bottom face 16 is located between the axis of rotation X of the spinning rotor 1 and the fiber collecting groove 14 at a distance from the axis of rotation X greater than half the distance between the axis of rotation X and the fiber collecting groove 14.

Preferably, the bottom face 16 is constructed in such a way that the deepest point 18 is located at a distance from the axis of rotation X of the spinning rotor 1 amounting from about two thirds to about three quarters of the distance between the axis of rotation X and the fiber collecting groove 14. The height difference between the highest point 17 and the lowest point 18 of the bottom face 16 is advantageously between from about one twentieth and to about one tenth of the diameter of the fiber collecting groove 14. In cross-section, the curved part of the bottom face 16 is constantly curved from the point 17 to the fiber collecting groove 14 and gradually changes into the fiber collecting groove 14. A frustoconical sliding surface 20 which narrows in the direction leading away from the fiber collecting groove 14 is connected to the other edge of the fiber collecting groove 14. This sliding surface 20 extends as far as the end of the right side of the spinning rotor 1.

As is apparent from the drawing, in this preferred embodiment, the concave curve of the bottom face 16 forms a shallow axially symmetrical channel which encompasses the axis of rotation X and the cross-section of which extends from the axis of rotation X to the fiber collecting groove 14.

The air jet *p* which is discharged from the air duct 6 and which can be switched on for a short period of time by a known control device which is not represented, for the purpose of cleaning the spinning rotor 1, skims over the bottom face 16 of the spinning rotor 1 toward the fiber collecting groove 14 where it collects the impurities deposited therein and carries them with it over the conical lateral sliding face 20 and finally over the edge of the spinning rotor 1 into the spinning chamber 9 surrounding the spinning rotor 1. The impurities are removed from the spinning chamber 9 by suction, via an air discharge opening 11 in the housing 10. This novel construction of the spinning rotor 1 offers considerable advantages when cleaning the fiber collecting groove 14 and when discharging the impurities removed. The novel structure of the bottom face 16 also provides favorable flow conditions in the inner chamber of the spinning rotor, even when the air jet *p* is not switched on, both for thread spinning and normal spinning, which results in a good quality yarn.

It is to be appreciated that the foregoing description and accompanying drawing relate to an exemplary embodiment of the invention given by way of example, not by way of limitation. Numerous other embodiments and variants are possible within the spirit and scope of the invention, the scope being defined by the appended claims.

What is claimed is:

1. In an open-end spinning device which includes a spinning rotor having an axis of rotation, a bottom face, a lateral sliding face conically widening toward the bottom face and intended for receiving fibers which have been fed into the spinning rotor and a fiber collecting groove located between the bottom face and the sliding face; and a blast air opening means having an axis disposed on a stationary part of the spinning device adjacent to an inner chamber of the spinning rotor for blowing fibers and foreign bodies from the fiber collecting groove to clean the same, the improvement comprising a shallow, concave curve defining an inwardly curved portion of said bottom face of said spinning rotor between said axis of rotation of said spinning rotor and said fiber collecting groove, with the cross-section of said inwardly curved portion of said bottom face being constantly curved between said axis of rotation of said spinning rotor and said fiber collecting groove gradually changing into said fiber collecting groove, and with said axis of said blast air opening being directed generally tangentially onto said inwardly curved surface of said bottom face.

2. An improved open-end spinning device as claimed in claim 1, wherein said bottom face of said spinning rotor possesses with respect to a plane which is perpendicular to said axis of rotation of said spinning rotor and which passes through a line of largest diameter of said fiber collecting groove, a raised section on said axis of rotation and a depression between said axis of rotation and said fiber collecting groove.

3. An improved open-end spinning device as claimed in claim 1, wherein a deepest point in the curved portion of said bottom face of said spinning rotor is located at a distance from said axis of rotation of said spinning rotor, this distance being greater than half the distance between said axis of rotation and said fiber collecting groove.

4. An improved open-end spinning device as claimed in claim 3, wherein said lowest point in the inwardly curved portion of said bottom face of said spinning rotor is located at a distance from said axis of rotation, this distance being in the range of between from about two-thirds to about three-quarters of the distance between said axis of rotation and said fiber collecting groove.

5. An improved open-end spinning device as claimed in claim 3, wherein said fiber collecting groove has a given diameter, and difference in height between a highest point of said curved portion and a lowest point in said bottom face of said spinning rotor in parallel direction to said axis of rotation of said spinning rotor is in the range of between from about one-twentieth to about one-tenth of said diameter of said fiber collecting groove.

6. An improved open-end spinning device as claimed in claim 1, wherein said axis of said blast air opening is directed toward said bottom face of said spinning rotor at an acute angle.

7. An improved open-end spinning device as claimed in claim 1, wherein said bottom face defines a concave curve and forms a shallow, axially symmetrical channel encompassing said axis of rotation.

8. An improved open-end spinning device as claimed in claim 7, wherein a cross-section of said channel extends from said axis of rotation to said fiber collecting groove.

* * * * *